US010655650B2

(12) United States Patent
Werner et al.

(10) Patent No.: US 10,655,650 B2
(45) Date of Patent: May 19, 2020

(54) VALVE BLOCK ARRANGEMENT AND METHOD FOR A VALVE BLOCK ARRANGEMENT

(71) Applicant: Robert Bosch GmbH, Stuttgart (DE)

(72) Inventors: Wilfried Werner, Ulm (DE); Botond Szeles, Senden (DE); Sebastian Oschmann, Nersingen (DE)

(73) Assignee: Robert Bosch GmbH, Stuttgart (DE)

( * ) Notice: Subject to any disclaimer, the term of this patent is extended or adjusted under 35 U.S.C. 154(b) by 26 days.

(21) Appl. No.: 16/016,408

(22) Filed: Jun. 22, 2018

(65) Prior Publication Data

US 2018/0372131 A1 Dec. 27, 2018

(30) Foreign Application Priority Data

Jun. 27, 2017 (DE) ..... 10 2017 210 823

(51) Int. Cl.

| | |
|---|---|
| ***F15B 13/12*** | (2006.01) |
| ***F15B 11/16*** | (2006.01) |
| ***F15B 13/08*** | (2006.01) |
| *E02F 9/22* | (2006.01) |

(52) U.S. Cl.

CPC ..... *F15B 13/12* (2013.01); *F15B 11/16* (2013.01); *F15B 13/08* (2013.01); *E02F 9/2267* (2013.01); *F15B 2211/255* (2013.01); *F15B 2211/31588* (2013.01); *F15B 2211/50554* (2013.01); *F15B 2211/513* (2013.01); *F15B 2211/5151* (2013.01); *F15B 2211/5157* (2013.01); *F15B 2211/526* (2013.01); *F15B 2211/6313* (2013.01); *F15B 2211/6336* (2013.01)

(58) Field of Classification Search

CPC .... F15B 2211/5157; F15B 2211/20576; F15B 2211/41563

See application file for complete search history.

(56) References Cited

U.S. PATENT DOCUMENTS 5,129,230 A * 7/1992 Izumi ..... E02F 9/2225 60/452
5,297,381 A * 3/1994 Eich ..... E02F 9/22 60/452
5,537,819 A * 7/1996 Kobayashi ..... E02F 9/2228 60/459
5,680,760 A * 10/1997 Lunzman ..... E02F 9/2228 60/426

(Continued)

FOREIGN PATENT DOCUMENTS

DE 10 2012 218 428 A1 4/2014
DE 10 2014 204 070 A1 9/2015

*Primary Examiner* — Thomas E Lazo

(74) *Attorney, Agent, or Firm* — Maginot, Moore & Beck LLP

(57) ABSTRACT

A valve block arrangement configured as a closed center system includes at least one main spool for controlling a hydraulic consumer. The main spool is configured to open and close at least one pressure medium connection between a hydraulic pump and the consumer in controlled, continuous fashion and, in at least one embodiment, is electrically activated. A bypass flow path with a cut valve branches off between the adjustable, hydraulic pump and the main spool. The cut valve is configured to open and close a pressure medium connection between the hydraulic pump and a tank in controlled, continuous fashion. The cut valve is electrically activatable.

14 Claims, 11 Drawing Sheets

(56) References Cited

U.S. PATENT DOCUMENTS

| | | | | |
|---|---|---|---|---|
| 5,873,245 | A * | 2/1999 | Kato | E02F 9/2225 60/445 |
| 6,173,572 | B1 * | 1/2001 | Cobo | E02F 9/2203 60/327 |
| 6,212,886 | B1 * | 4/2001 | Sugiyama | E02F 9/2225 60/422 |
| 6,378,303 | B1 * | 4/2002 | Higuchi | E02F 9/2235 60/468 |
| 6,446,433 | B1 * | 9/2002 | Holt | F04B 49/065 60/433 |
| 7,320,216 | B2 * | 1/2008 | VerKuilen | E02F 9/2235 60/421 |
| 7,331,175 | B2 * | 2/2008 | VerKuilen | E02F 9/2242 60/429 |
| 7,350,353 | B2 * | 4/2008 | Ioku | E02F 9/2239 60/421 |

* cited by examiner

VALVE BLOCK ARRANGEMENT AND METHOD FOR A VALVE BLOCK ARRANGEMENT

This application claims priority under 35 U.S.C. § 119 to patent application no. DE 10 2017 210 823.1, filed on Jun. 27, 2017 in Germany, the disclosure of which is incorporated herein by reference in its entirety.

BACKGROUND

The disclosure relates to a valve block arrangement having a closed center valve block which has at least one main spool, in order for a hydraulic consumer to be controlled by means thereof. The disclosure also relates to a method for controlling the valve block arrangement.

Closed center systems involve a hydraulic circuit in which directional valves for controlling consumers are closed when in their central position. The volume flow is then, in the case of closed directional valves, conducted normally via a recirculation valve in the case of fixed displacement pumps being used as a pressure medium source. In the case of an open center system, a hydraulic circuit is provided in which series-connected directional valves for controlling consumers are open to the oil flow when in their central position, such that a pump delivery flow of a fixed displacement pump can be conducted through all of the directional valves. If only one directional valve is provided, then in the central position thereof, the pressure medium volume flow can be conducted to the tank, thus being referred to as neutral recirculation.

DE 10 2012 218 428 A1 discloses an open center valve block. Said valve block has a multiplicity of main spools for controlling consumers. A respective main spool can be fed in parallel with pressurized fluid via a first and second pump channel. The fluid flow flowing from each of the pump channels is controlled by means of an associated first and second auxiliary spool respectively.

SUMMARY

By contrast, it is the object of the disclosure to provide a valve block arrangement having a closed center valve block which, in a simple manner in terms of apparatus, at least partially exhibits the behavior of an open center valve block. The disclosure is furthermore based on the object of providing a method for controlling a valve block arrangement with a closed center valve block, by means of which method said valve block arrangement at least partially exhibits open center behavior.

Said object is achieved, with regard to the valve block arrangement, in accordance with the features of the disclosure and, with regard to the method, in accordance with the features of the disclosure.

The subclaims relate to further advantageous refinements of the disclosure.

According to the disclosure, a valve block arrangement or a control block arrangement is provided. Said arrangement has a closed center valve block. The latter may have at least one in particular electrically activated main spool or main valve spool, which is provided for controlling a hydraulic consumer. The main spool may be assigned a pressure port and a working port in order for the connection thereof to be opened and closed in controlled fashion, for example. Furthermore, it is preferable for at least one, in particular adjustable, hydraulic machine to be provided, which is connected to the pressure port. A bypass flow path may branch off between the pressure port and the at least one hydraulic machine. Said bypass flow path may then be connectable by means of an electrically activated cut valve to a tank or to a low-pressure side and throttlable by means of said cut valve.

This solution has the advantage that, despite the closed center valve block which is of simple design in terms of apparatus, a desired load dependency or load sensitivity of an open center system can be implemented. Since the cut valve is electrically activated, an opening cross section of the cut valve can be defined in a flexible manner. The smaller the opening cross section of the cut valve, the more rigid the hydraulic system is, and the lower the load sensitivity is. If, for example, the main spool is used for controlling a bucket of a bucket excavator, and the bucket strikes a pipe, for example, during operation, the speed of the bucket would become considerably slower in the case of high load sensitivity. An excavator operator would hereby identify, from the relatively low speed of the bucket, that the bucket has struck an obstacle, whereby he or she can thus "sense" the load. In the case of low load sensitivity, that is to say in the case of a comparatively small opening cross section of the cut valve, the speed of the bucket movement, for example upon striking the pipe, would not change or would not change substantially or would change only little, whereby, under some circumstances, the excavator operator will not notice this situation. There is then low load sensitivity available for the operation of the excavator. Thus, by means of the electrically activated cut valve, the desired load dependency in the closed center valve block can be realized as in an open center system in a simple manner in terms of apparatus.

The bypass flow path branches off, in a simple manner in terms of apparatus, outside the valve block, whereby a closed center valve block which is of simple design in terms of apparatus can be provided.

It is also conceivable that, in addition to the one main spool, at least one further main spool is provided. The main spools may then each be provided for controlling a respective hydraulic consumer. For this purpose, a respective main spool may then be assigned a respective pressure port and a respective working port. The at least one hydraulic machine is then preferably connected to a respective pressure port. The bypass flow path with the cut valve may then branch off fluidically between the pressure ports and the at least one hydraulic machine, in particular outside the closed center valve block. It is thus possible in a simple manner in terms of apparatus for the closed center valve block with its open center behavior to also be used for a multiplicity of main spools and thus a multiplicity of consumers.

In other words, a closed center control block is provided, wherein preferably no bypass flow path is provided through the control block and through the main spools, wherein the main spools can be supplied directly with pressure medium in parallel via a distribution line. To realize open center behavior, it is then preferably possible for a bypass to branch off between the hydraulic machine and the distribution line, which bypass is throttlable by means of the electronically actuated cut valve.

In a further embodiment of the disclosure, it may be provided that a respective main spool or at least some of the main spools is assigned in each case one in particular electrically activated adjustable throttle. Said throttle is then arranged fluidically preferably between the pressure port of the respective main spool and the at least one hydraulic machine. This yields the possibility of controlling the throttle such that, upon activation—in addition to a first main spool or first consumer—of a second main spool or second consumer with a different load pressure in relation to the first consumer, a change in speed of the first consumer can be, at least substantially, prevented. Thus, a further main spool can be activated in addition to the first main spool as if the consumer actuated by means of the further main spool were actuated on its own, while the respective throttles or throttle valves balance the pressure levels such that a desired distribution of the pressure medium volume flows occurs. The effect achievable by means of the throttles and the open center behavior conventionally conflict with one another in the prior art. By means of the valve block arrangement according to the disclosure, it is possible in the case of the closed center valve block both to achieve an open center behavior and to prevent or at least substantially prevent a change in speed of a first consumer upon activation of a second consumer.

The throttles are preferably formed in the valve block. They may be arranged fluidically in parallel and connected, on the one hand, in each case to the respective associated main spool and, on the other hand, to the hydraulic machine. The bypass flow path may then branch off fluidically between the throttles and the hydraulic machine. Said bypass flow path may thus branch off upstream of the throttles. For the control of a respective throttle, a valve spool activation means or an actuator may be provided.

It is preferably possible for the main spool or at least one of the main spools or some of the main spools or all of the main spools to be assigned not only the pressure port and the working port but also a tank port and/or a further working port. Then, via the tank port, it is for example possible for pressure medium to flow out from the consumer. By means of the further working port, it is conceivable for a double-acting cylinder to be provided as a consumer. It is preferably provided that the main spool or some of the main spools or all of the main spools are adjustable in continuous fashion. A degree of actuation of the main spool or of the individual main spools can then be provided as an adjustment element.

In a preferred embodiment, a main spool can be moved into an in particular spring-centered central position in which the ports assigned to the main spool are separated from one another. Proceeding from the central position, when the main spool is displaced in the direction of first switched positions, the pressure port can be connected to the first working port and the tank port can be connected to the second working port. When the main spool is displaced proceeding from the central position in the direction of second switched positions, wherein the direction is opposite to the first switched positions, it is then possible for the pressure port to be connected to the second working port and for the first working port to be connected to the tank port. For the adjustment of the main spool, a valve spool activation means or an actuator is provided. Here, a first actuator can be used for a first adjustment direction and a second actuator can be used for a second adjustment direction. Further main spools may be designed correspondingly.

In a further embodiment of the disclosure, the cut valve may be openable and closable in controlled, continuous fashion in order to flexibly adjust the load sensitivity. The cut valve is preferably open when in a main position, whereby the hydraulic machine is connected to the tank. A valve spool of the cut valve is loaded in the direction of the main position by means of a spring force of a valve spring. In an opposite direction, the valve spool of the cut valve can be displaced in the direction of closed positions by means of a valve spool activation means or by means of an actuator.

In a further embodiment of the disclosure, it may be provided that the hydraulic machine is subjected to volume flow closed-loop control or pressure closed-loop control. A flow rate adjustment of the hydraulic machine, which is designed for example in the form of a hydraulic pump, can then serve as a further adjustment element. A pressure sensor is preferably provided downstream of the hydraulic machine. The hydraulic machine can preferably convey pressure medium from the tank to the main spool. Furthermore, the hydraulic machine may be equipped with a pivot angle sensor/delivery-rate-proportional measurement system.

In a further embodiment of the disclosure, the throttle or the throttles or some of the throttles is or are designed such that a backflow of pressure medium from the associated consumer via the throttle or via the respective throttle is prevented.

In this way, a load-maintaining function is implemented even when the main spool is open. The throttle or a respective throttle or some of the throttles may in this case be formed as a valve assembly. This then preferably has a first seat valve body assigned to a valve seat. By means of said seat valve body, it is then possible for a pressure medium connection between a first working chamber, connected to the hydraulic machine, and a second working chamber, connected to the associated pressure port, to be opened and closed in controlled fashion. The seat valve body can be acted on in the direction of the valve seat with pressure medium via a control chamber. Via a further seat valve body, which is assigned a further valve seat, a pressure medium connection between the second working chamber and the control chamber can then be controlled.

The second working chamber is then connected by means of the further valve seat to the control chamber such that a pressure medium acting from the second working chamber forces the further valve body in the direction away from the valve seat. Furthermore, a pressure medium acting from the control chamber is provided, which pressure medium forces the further valve body toward the further valve seat. The second working chamber may then be connected by means of a pilot control valve, bypassing the further valve seat, to the control chamber. The pilot control valve is preferably designed such that it can selectively shut off or open up the connection from the second working chamber to the control chamber. In the case of a flow through the valve assembly from the first working chamber to the second working chamber, a pressure in the first working chamber is greater than in the second working chamber. Thus, the pressure in the control chamber is also greater than in the second working chamber. The further valve body then accordingly closes off the further valve seat, for as long as the pilot control valve is closed. As soon as the pilot control valve is opened, pressure medium flows out of the control chamber toward the second working chamber. As a result, the pressure in the control chamber falls, such that the further valve seat is opened. Accordingly, a pilot control volume flow then flows from the control chamber to the second working chamber, whereby control of the main volume flow is realized. If a pressure in the second working chamber then rises above the pressure in the first working chamber, then the further valve body is lifted off from the second valve seat regardless of the position of the pilot control valve. Pressurized fluid then flows from the second working chamber into the control chamber. As a result, the volume of the first control chamber increases, whereby the first valve body is pushed against its valve seat. In this way, a connection from the first to the second working chamber is then shut off. No pressure medium can then flow from the second to the first working chamber. With regard to further information regarding the valve assembly, reference is made to the document DE 10 2014 204 070 A1, the content of which, with regard to the valve assembly, in particular further aspects of the valve assembly, are hereby incorporated into this application.

In a further embodiment of the disclosure, the pressure port of the main spool or of at least one main spool or of some of the main spools or of all of the main spools is connected to at least or in each case to at least two hydraulic machines arranged fluidically in parallel. Thus, in addition to the hydraulic machine mentioned above, at least one further hydraulic machine is provided which may be designed in accordance with one or more of the preceding aspects. By means of two hydraulic machines, a high volume flow can be provided with relatively little structural space requirement. Furthermore, more flexible activation is made possible.

In a preferred refinement of the disclosure, a throttle according to one or more of the abovementioned aspects may be arranged between a respective hydraulic machine and the associated pressure port of the main spool or of some of the main spools or of all of the main spools.

In an alternative embodiment, it is conceivable that a throttle according to one or more of the above aspects is provided between one of the hydraulic machines and the associated pressure port of the main spool or of some of the main spools or of all of the main spools, and that a check valve is provided between the further hydraulic machine and the associated pressure port of the main spool or of some of the main spools or of all of the main spools. Thus, one hydraulic machine can be connected via a throttle to a main spool, and the other hydraulic machine can then be connected by means of a check valve to the main spool.

It is also conceivable for a main spool to be connected via a respective throttle to the respective hydraulic machine, whereas at least one further main spool is connected on the one hand by means of a throttle to one of the hydraulic machines and on the other hand by means of the check valve to the correspondingly other hydraulic machine. A load-maintaining function is made possible in an inexpensive manner by means of the check valve. Alternatively or in addition, it may be provided that a main spool is connected via a respective check valve to a respective hydraulic machine.

If multiple hydraulic machines are provided, then it is preferable for a bypass flow path with a cut valve to be provided for a respective hydraulic machine.

In a simple manner in terms of apparatus, the main spool, or some of the main spools or a respective main spool, may be provided in a valve disk. The valve block can thus be provided with an arbitrary number of main spools, depending on the number of consumers, in a simple manner in terms of apparatus. It is then possible for at least one throttle to be provided in a valve disk or in some of the valve disks or in a respective valve disk. If two hydraulic machines are provided, then it is preferable if not only the one throttle but also a further throttle or the check valve is provided in a valve disk or in some of the valve disks or in a respective valve disk. The valve disks may thus have not only a main spool but also at least one upstream throttle.

In a further embodiment of the disclosure, a set of control electronics is provided. Said set of control electronics may have an adaptation module or a first module. In this, it is then possible for a preset value to be input or fed in for a consumer or for a respective consumer or for a main spool or for a respective main spool, in particular by means of an input unit or a respective input unit. The preset value or a respective preset value may then, by means of the adaptation module, be changed into an adapted or into a respective adapted preset value. In other words, in the adaptation module, a preset value may be adapted, in particular smoothed, for each consumer. As an input unit, it is for example the case that a joystick is provided, wherein a joystick signal can then serve as a preset value. The preset value is changed into an adapted preset value for example by means of a monotonous or continuously rising characteristic curve and/or by means of a time function, such as for example PT1 or PT2. By means of the adaptation of the preset value, signal conditioning is advantageously made possible. A joystick is preferably provided for the main spool. If a multiplicity of main spools is provided, then a respective joystick may be provided for some or for a respective main spool.

It is advantageous for a or the set of control electronics to have a preset module or second module. With this, it is then possible for an, in particular adapted, preset value or a respective, in particular adapted, preset value to be converted into a volume flow preset for the consumer or into a respective volume flow preset for a respective consumer. Furthermore, by means of the preset module, it is preferably possible for the, in particular adapted, preset value, or a respective, in particular adapted, preset value, to be converted into an, in particular desired, item of load sensitivity information or into an, in particular desired, respective item of load sensitivity information for the consumer or for the corresponding consumer. Alternatively or in addition, by means of the preset module, it may be provided that the, in particular adapted, preset value or that a respective, in particular adapted, preset value is converted into an, in particular desired, or in each case into an, in particular desired, maximum pressure. With the item of load sensitivity information, a throttling preset for the cut valve is provided, whereby it is then advantageously possible for a dynamic pressure with which the consumer can be supplied in accordance with the open center principle to be adjusted. The volume flow preset can then predefine the speed of the consumer. With the maximum pressure for a respective consumer, it is advantageously possible to implement an upward adjustment of the hydraulic machine in a manner dependent on the preset values or actuation signals.

The volume flow preset for the consumer or for a respective consumer may then be gathered, by means of a characteristic map, as a function of the adapted preset value with respect to the corresponding consumer. Alternatively or in addition, for the respective item of load sensitivity information of the consumer or of a respective consumer, which is based on the (respective) adapted preset value of the consumer, a characteristic map may be provided. It is furthermore alternatively or additionally possible for a characteristic map for the (respective) maximum pressure for the consumer or for a respective consumer to be gathered, which is likewise based on the adapted preset value with regard to the consumer or the corresponding consumer. On the basis of the characteristic map or the characteristic maps, it is thus possible for the preset value or the preset values to be converted in an extremely simple manner.

In a further embodiment of the disclosure, the set of control electronics or a set of control electronics may have an actuation module or third module. This may then generate an actuation signal or actuation signals on the basis of the converted preset or the converted presets of the preset module. A total volume flow preset for the hydraulic machine and/or a total throttling preset for the cut valve and/or a control variable or a respective control variable for the main spool or for some of the main spools or for a respective main spool and/or a control variable or a respective control variable for a throttle or some of the throttles or for a respective throttle may be provided as actuation signal(s). In other words, a third module can combine the consumer-based input values and generate the individual actuation signals. In the case of the actuation module, it is furthermore possible for a load pressure of a consumer or of some of the consumers or of all of the consumers to be taken into consideration for generating the actuation signal or the actuation signals, in order to permit improved load sensitivity. The load pressure or the load pressures are preferably preset and based for example on empirical values. Alternatively or in addition, provision may be made for the load pressure or the load pressures to be detected by means of one or more sensors. It is thus possible, by means of the calculation variables of the adapted preset value and/or the maximum pressures for a respective consumer and/or the volume flow preset for a respective consumer and/or the load sensitivity information for a respective consumer and/or the load pressures for a respective consumer, to calculate the control variables for the valve spool activation means of the main spool and/or of a pump activation means for the at least one hydraulic machine and/or for the valve spool activation means of the cut valve.

In a further embodiment of the disclosure, it is conceivable that, in the actuation module, a rotational speed of the hydraulic machine or of the hydraulic machines is taken into consideration for generating the actuation signal or the actuation signals. In this way, a more accurate generation can be performed in a simple manner in terms of apparatus. The rotational speed of the hydraulic machine or of the hydraulic machines may be implemented as a predetermined parameter, for example based on empirical values, or as a measured value, which is detected for example by means of one or more sensors.

In other words, the data for the activation of the individual consumers are fed into an actuation module which can activate the valves of the individual consumers, the cut valve and the pump activation means, in accordance with predefined processing operations.

The activation by means of the actuation signal or the actuation signals is preferably realized as non-feedback open-loop control, or in the "feedforward mode". This leads to activation which is extremely simple in terms of apparatus.

The modules for the set of control electronics may, in a simple and inexpensive manner, be software modules which are implemented in particular on the set of control electronics.

In a further embodiment of the disclosure, the control variable for the hydraulic machine or for the hydraulic machines, which control variable is generated in particular by the actuation module, may be realized as the sum of the volume flow presets. In other words, a degree of adjustment of the pump or of the pumps may be realized as a simple sum of the demanded flow rates. Here, a factor for a pump characteristic variable may be taken into consideration. Alternatively or in addition, it is possible here for an item of rotational speed information of the hydraulic machine or of the hydraulic machines to be incorporated, which may be a setpoint rotational speed and/or an actual rotational speed.

The control variable for the cut valve is preferably implemented on the basis of the smallest item of load sensitivity information. In other words, the cut valve can be activated for example with the minimum of the individual demands.

The control variable for the main spool or for the main spools may advantageously be formed from the, in particular adapted, preset value(s). It is preferable for multiple main spools to be controlled such that, assuming certain typical fixedly predefined load pressures, the flow rate predefined for example by the user at the joystick is distributed to the individual consumers.

In a further embodiment of the disclosure, the control variable for the throttle or the throttles may be implemented on the basis of the, in particular adapted, preset value and/or on the basis of the volume flow presets and/or on the basis of the load pressure or the load pressures.

To further improve the actuation of the consumers, it is conceivable for a pressure loss in the hydraulic system to be taken into consideration.

According to the disclosure, a method for or having a valve block arrangement according to one or more of the preceding aspects is provided. The method may have the following steps:

- Converting the, in particular adapted, preset value or the respective, in particular adapted, preset value into a volume flow preset for the consumer or the main spool or for the corresponding consumer or main spool.
- Alternatively or in addition, provision may be made for converting the, in particular adapted, preset value or the respective, in particular adapted, preset value into an, in particular desired, item of load sensitivity information or into a respective item of load sensitivity information for the consumer or for the corresponding consumer.
- Alternatively or in addition, provision may be made for converting the, in particular adapted, preset value or the respective, in particular adapted, preset value into an, in particular desired, maximum pressure for the consumer or for the respective consumer.
- Furthermore, provision may alternatively or additionally be made for generating an actuation signal or actuation signals from the converted preset value(s). For example, a total volume flow preset for the hydraulic machine and/or a total throttling preset for the cut valve and/or a control variable or a respective control variable for the main spool or for some of the main spools or for all of the main spools and/or a respective control variable for a throttle or for some of the throttles or for a respective throttle is/are provided as actuation signal (s).

BRIEF DESCRIPTION OF THE DRAWINGS

Preferred exemplary embodiments of the disclosure will be discussed in more detail below on the basis of schematic drawings, in which.

DETAILED DESCRIPTION

Figure 1:
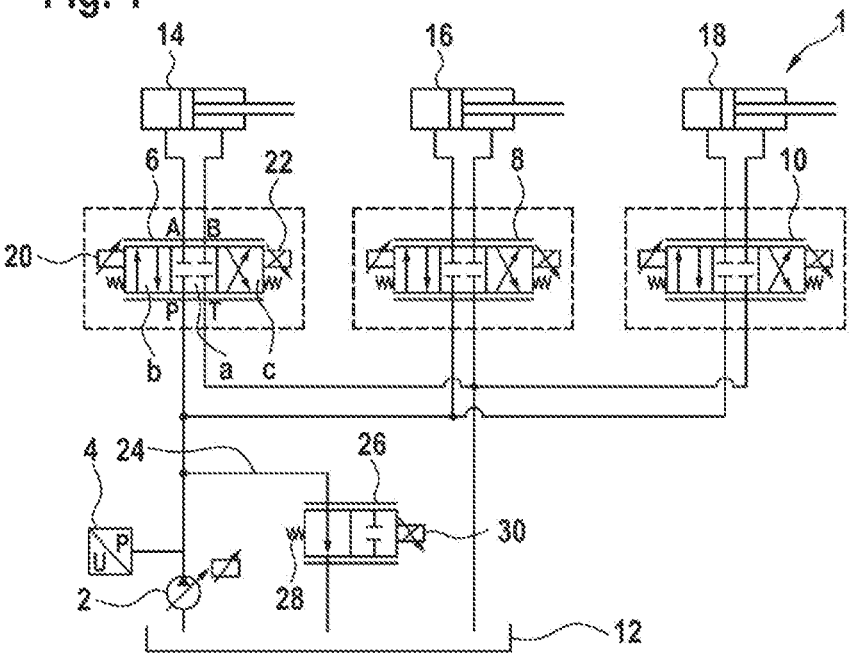
FIG. 1 shows, in a hydraulic circuit diagram, a valve block arrangement according to a first exemplary embodiment.

As per FIG. 1, a valve block arrangement 1 has a hydraulic machine in the form of a hydraulic pump 2. The latter is in particular electrically adjustable. To the outlet side of the hydraulic pump 2, there is connected a pressure sensor 4 for detecting an outlet pressure of the hydraulic pump 2. Three main valves or main spools 6, 8 and 10 arranged fluidically in parallel are fluidically connected to the hydraulic pump 2. Said main valves or main spools each have a pressure port P, which is connected in each case to the hydraulic pump 2, wherein, for the sake of simplicity, the alphabetic characters of the ports are shown only for the main spool 6. Furthermore, a respective main spool 6, 8 and 10 has a tank port T which is connected to a tank 12. Furthermore, a respective main spool 6 to 10 has a first and second working port A, B. In each case one consumer 14, 16 and 18 is connected to said working port. Thus, a respective main spool 6 to 10 serves for controlling a respective consumer 14 to 18 assigned thereto. The consumers 14 to 18 are each differential cylinders with a piston rod on one side.

A respective main spool 6 to 10 is spring-centered in its main position a. Proceeding from its main position a, a respective main spool 6 to 10 can be actuated in the direction of first switched positions b by means of actuators 20, 22. Here, the pressure port P is connected to the working port A, and the working port B is connected to the tank port T. Furthermore, a respective main spool 6 to 10 is displaceable from its main position a in the direction of switched positions c opposite to the switched positions b. Here, a respective pressure port P is connected to the second working port B, and the first working port A is connected to the tank port T. The main spools 6 to 10 are adjustable in continuous fashion.

A bypass flow path 24 branches off fluidically between the main spools 6 to 10 and the hydraulic pump 2, which bypass flow path is connected to the tank 12. A cut valve 26 which is electrically adjustable in continuous fashion is provided in said bypass flow path. A valve spool of the cut valve 26 is acted on in the direction of its opening positions by a spring force of a valve spring 28. The valve spool of the cut valve 26 can be acted on with a force in the direction of closing positions by an actuator 30, which is electrically activatable. It is thus possible for a pressure medium connection between the outlet side of the hydraulic pump 2 and the tank 12 to be controlled by means of the cut valve 26.

The valve block arrangement 1 is a closed center system, wherein, in the neutral position or main position a of the main spools 6 to 10, the pressure medium connections are closed. Owing to the adjustable hydraulic pump 2 and the cut valve 26, a load dependency or load sensitivity for a user of the valve block arrangement 1, as is provided in the case of an open center system, is nevertheless also made possible here, as will be discussed below.

Figure 2:
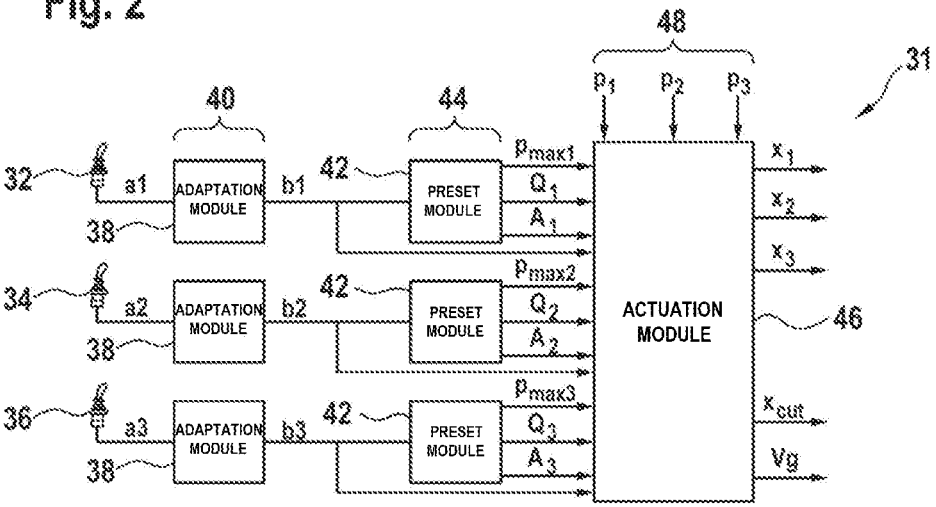
FIG. 2 shows, in a schematic illustration, a set of control electronics of the valve block arrangement from FIG. 1, FIGS. 3*a* and 3*b* each show a characteristic curve with regard to the signal conditioning.
Figure 3A:
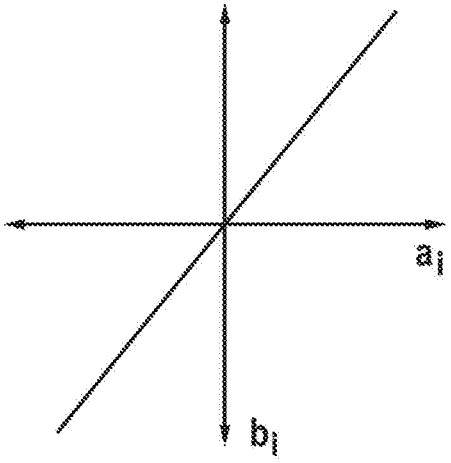
FIG. 3*c* shows a time function with regard to the signal conditioning, FIGS. 4*a* to 4*c* each show a characteristic curve with regard to the generation of different control variables from a preset value.
Figure 3B:
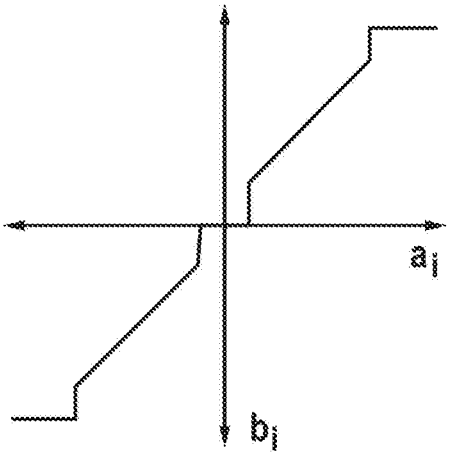
Figure 3C:
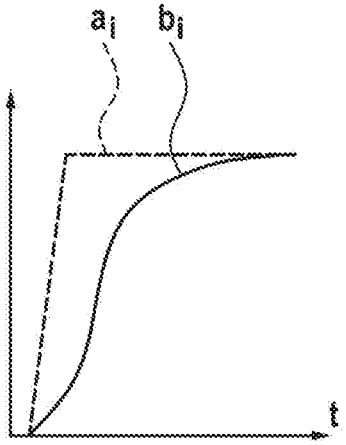

FIG. 2 illustrates a set of control electronics 31 of the valve block arrangement 1 from FIG. 1. Here, for the control of a respective consumer 14 to 18, see FIG. 1, in each case one joystick 32, 34 and 36 is provided, which joysticks are connected in each case to the set of control electronics 31. A respective joystick 32 and 36 is in each case connected to a block 38, which blocks are part of an adaptation module or first module 40. Therein, a respective preset value a1 to a3 preset by the joysticks 32 to 36 is adapted. Subsequently, a respective adapted preset value b1 to b3 is output by the respective block 38. The adaptation is performed on the basis of characteristic curves as per FIGS. 3*a* and 3*b* and on the basis of a time function, such as for example PT1 or PT2, as per FIG. 3*c*.

Figure 4A:
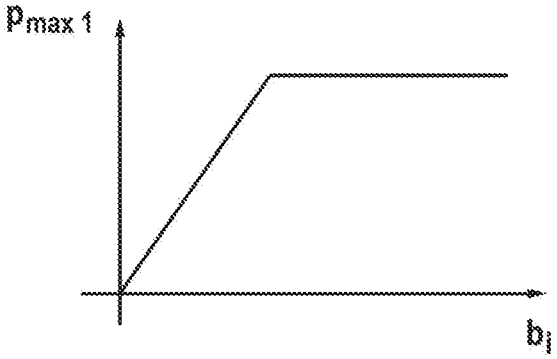
Figure 4B:
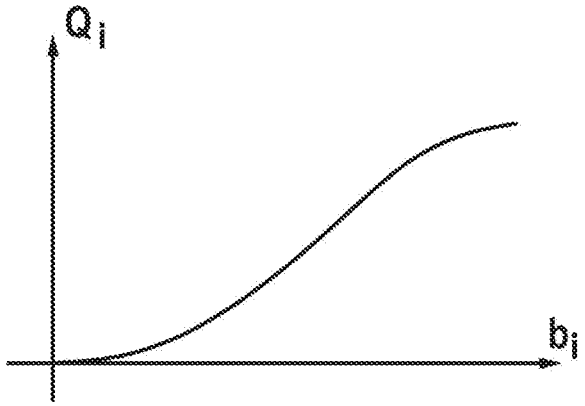
Figure 4C:
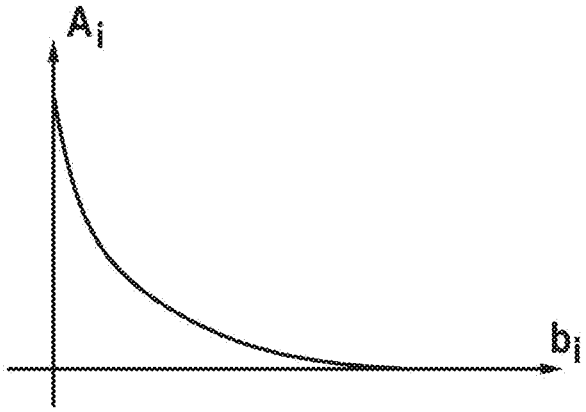

The respectively adapted preset value b1 to b3 is fed into a respective block 42 of the set of control electronics 31. The blocks 42 form a preset module or second module 44. The preset values b1 to b3 are then, in their respective block 42, converted by means of a characteristic curve as per FIG. 4*a* into a maximum pressure p_max_1 to p_max_3. As per FIG. 4*a*, the maximum pressure p_max_i increases linearly with the respective increasing adapted preset value bi up to a particular value, beyond which the maximum pressure p_max_i then remains constant even if the respective adapted preset value b1 to b3 increases further. Thus, at the start of a respective deflection of a joystick 32 to 36, a respective preset for the maximum pressure p_max_1 to p_max_3 will increase in continuous fashion together with the deflection. Beyond a certain actuation travel of the respective joystick 32 to 36, the respective maximum pressure p_max_1 to p_max_3 then remains constant. Furthermore, in the second module, a respective adapted preset value b1 to b3 is converted into a respective volume flow preset Q1 to Q3 for the respective consumer 14 to 18, see FIG. 1. Said volume flow preset is adapted in each case in accordance with the characteristic curve in FIG. 4*b*. Accordingly, a respective volume flow preset Q1 to Q3 increases with the respective adapted preset value b1 to b3. Furthermore, a desired item of load sensitivity information A1 to A3 is generated in a respective block 42 of the second module 44. A respective item of load sensitivity information A1 to A3 is, as per the characteristic curve in FIG. 4*c*, likewise dependent in each case on the adapted preset value b1 to b3. The greater the preset value b1 to b3, the lower the respective item of load sensitivity information A1 to A3.

As per FIG. 2, the adapted preset values b1 to b3, the volume flow presets Q1 to Q3, the items of load sensitivity information A1 to A3 and the maximum pressures p_max_1 to p_max_3 are fed into a block 46 of the set of control electronics. Said block forms an actuation module or third module 48. Furthermore, load pressures p1 to p3 of a respective consumer 14 to 18 are fed into the block 46. From the fed-in calculation variables and load pressures p1 to p3, the control variables or actuation signals x1 to x3 for a respective main spool 6 to 10, see FIG. 1, are generated.

Furthermore, a control signal x_cut for the cut valve 26 is generated as a total throttling preset. Furthermore, a total volume flow preset V_g for the hydraulic pump 2 is output.

The control variables or positioning variables x1 to x3 for the main spools 6 to 10 are obtained from the following formula: xi=k*bi, wherein i stands for a respective value 1 to 3. The control signal for the cut valve 26 can be determined from the smallest item of load sensitivity information A1 to A3: x_cut=min(A1, A2, A3). Alternatively, the control signal for the cut valve may be calculated from the physical relationship of the series-connected orifices: x_cut=1/(1/A1+1/A2+1/A3). The positioning variable for the pump activation means of the hydraulic pump 2, or the total volume flow preset V_g, arises from the individual consumer demands and from a factor k for the pump characteristic variable: V_g=(Q1+Q2+Q3)*k.

Figure 5:
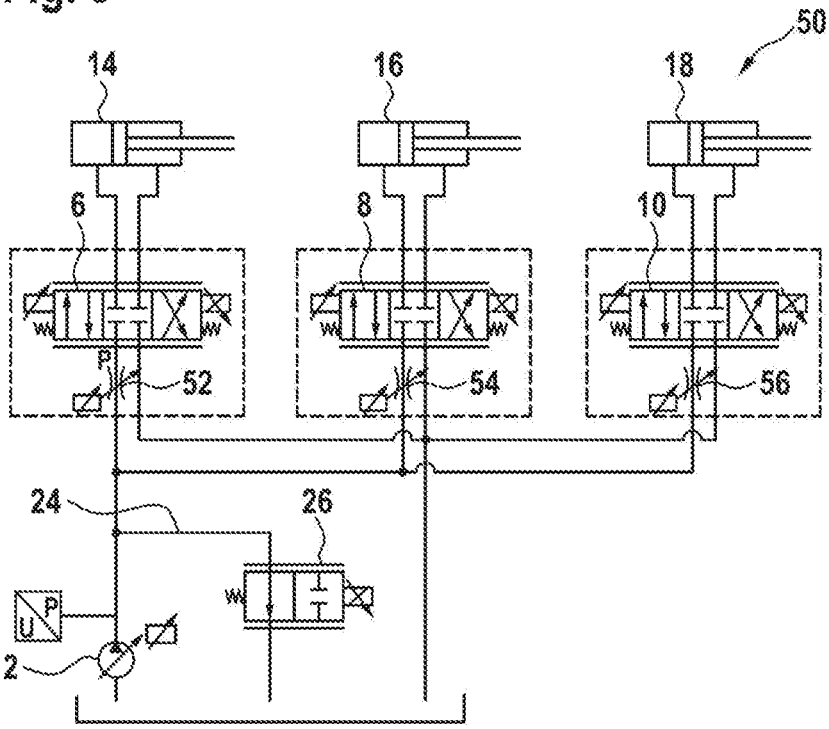
FIG. 5 shows, in a hydraulic circuit diagram, a valve block arrangement according to a further exemplary embodiment.

FIG. 5 illustrates a further embodiment of a valve block arrangement 50. By contrast to the embodiment in FIG. 1, an adjustable throttle 52, 54, 56 is connected upstream of the pressure port P of a respective main spool 6 to 10. The throttles 52 and 56 have the advantage that, in the case of an activation of a second consumer 14, 16, 18 in addition to a first consumer 14, 16, 18 and with different load pressure in relation to the first consumer 14, 16, 18, a change in speed of the first consumer 14, 16, 18 is prevented or is prevented as far as possible. The throttles 52 to 56 are arranged fluidically in parallel with respect one another and are jointly connected to the hydraulic pump 2. The bypass flow path 24 with the cut valve 26 then branches off fluidically between the hydraulic pump 2 and the throttles 52 to 56.

Figure 6:
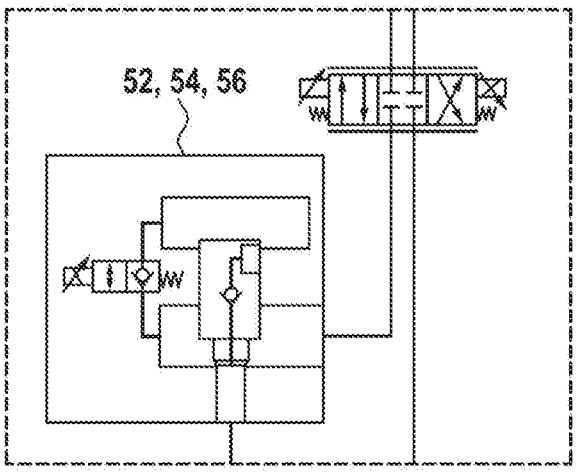
FIG. 6 shows, in a hydraulic circuit diagram, a main spool with an upstream throttle as per an embodiment.

FIG. 6 illustrates an embodiment of the throttles 52 to 56. For more detailed information, reference is made to the explanations above and to the applicant's document DE 10 2014 204 070 A1. The throttles 52 to 56 are in this case designed so as to additionally be used as load-maintaining valves. Thus, the throttles 52 and 56 perform a dual function, in a manner which saves structural space.

Figure 7:
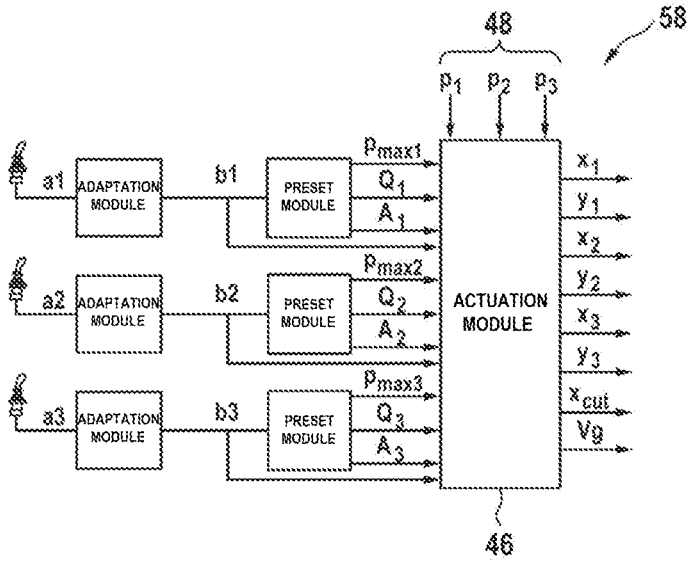
FIG. 7 shows, in a schematic illustration, a set of control electronics of the valve block arrangement from FIG. 5 as per an embodiment.

FIG. 7 shows a set of control electronics 58 of the valve block arrangement 50 from FIG. 5. By contrast to FIG. 2, control variables y1 to y3 for the throttles 52 to 56 are generated in the block 46 of the third module 48.

Figure 8:
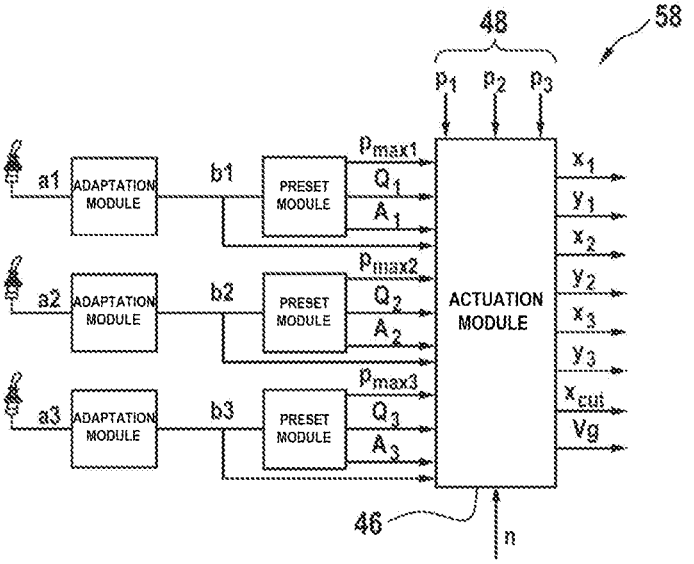
FIG. 8 shows, in a schematic illustration, a set of control electronics for the valve block arrangement from FIG. 5 as per a further embodiment.

FIG. 8 illustrates the set of control electronics 58 from FIG. 7, wherein a rotational speed n of the hydraulic pump 2, see FIG. 5, is additionally taken into consideration in the block 46.

Figure 9:
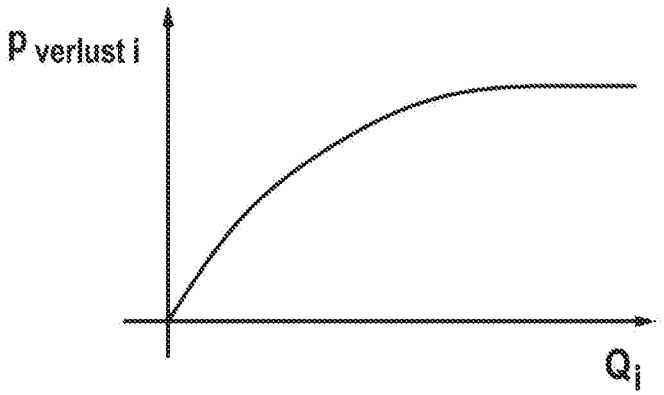
FIG. 9 shows, in a characteristic curve, a pressure loss in the case of the valve block arrangement from FIG. 5 as a function of the respective consumer volume flow.

In FIGS. 7 and 8, the control signals x1 to x3, the control signal x_cut and the total volume flow preset V_g are calculated in accordance with the formulae stated above. In FIG. 8, the total volume flow preset V_g may alternatively be calculated taking into consideration the rotational speed n: V_g=((Q1+Q2+Q3)/n)*1000. In FIGS. 7 and 8, the control variables for the throttles y1 to y3 are determined taking into consideration the adapted preset values b1 to b3, the volume flow presets Q1 to Q3 and the maximum pressures p_max_1 to p_max_3. In an intermediate step, it is the case here that a typical pump pressure of the hydraulic pump 2 is calculated as a function of the actuation of the consumers: p_pump=max(p1*sign(b1), p2*sign(b2), p3*sign(b3)). Here, to increase the accuracy, it is also possible for a pressure loss of the hydraulic system to be taken into consideration in the demanded volume flow, which may be realized in FIG. 9 in accordance with the illustrated characteristic curve. It can be seen here that, the higher a volume flow preset Q1 to Q3 is, the higher a pressure loss p_verlust_1 to p_verlust_3 is. The typical pump pressure of the hydraulic pump 2 is then obtained, in the case of a consumer actuation, from the following formula: p_pump=max((p1+p_verlust_1)*sign(b1), (p2+p_verlust_2)*sign(b2), (p3+p_verlust_3)*sign(b3)). The control variables for the throttles y1 to y3 may then be calculated, from the pressure drop dp1 to dp3 across the respective adjustable throttle 52 to 56 and the respective volume flow preset Q1 to Q3, by means of the following formula: y_i=Q_i/(α*√(2*dp_i/φ)). The pressure drop across each throttle 52 to 56 can then be calculated from the load pressures p1 to p3 and the typical pump pressure p_pump: dp_i=p_pump−p_i. To improve the calculation, it is also possible for the volume-flow-dependent losses to also be taken into consideration: dp_i=p_pump−p_i−p_verlust_i. Thus, all of the variables for the calculation of the control variables y1 to y3 for the throttles are then known, and said control variables can be calculated in accordance with the following formula: y_i=Q_i/(α*√(2*dp_i/φ)).

Figure 10:
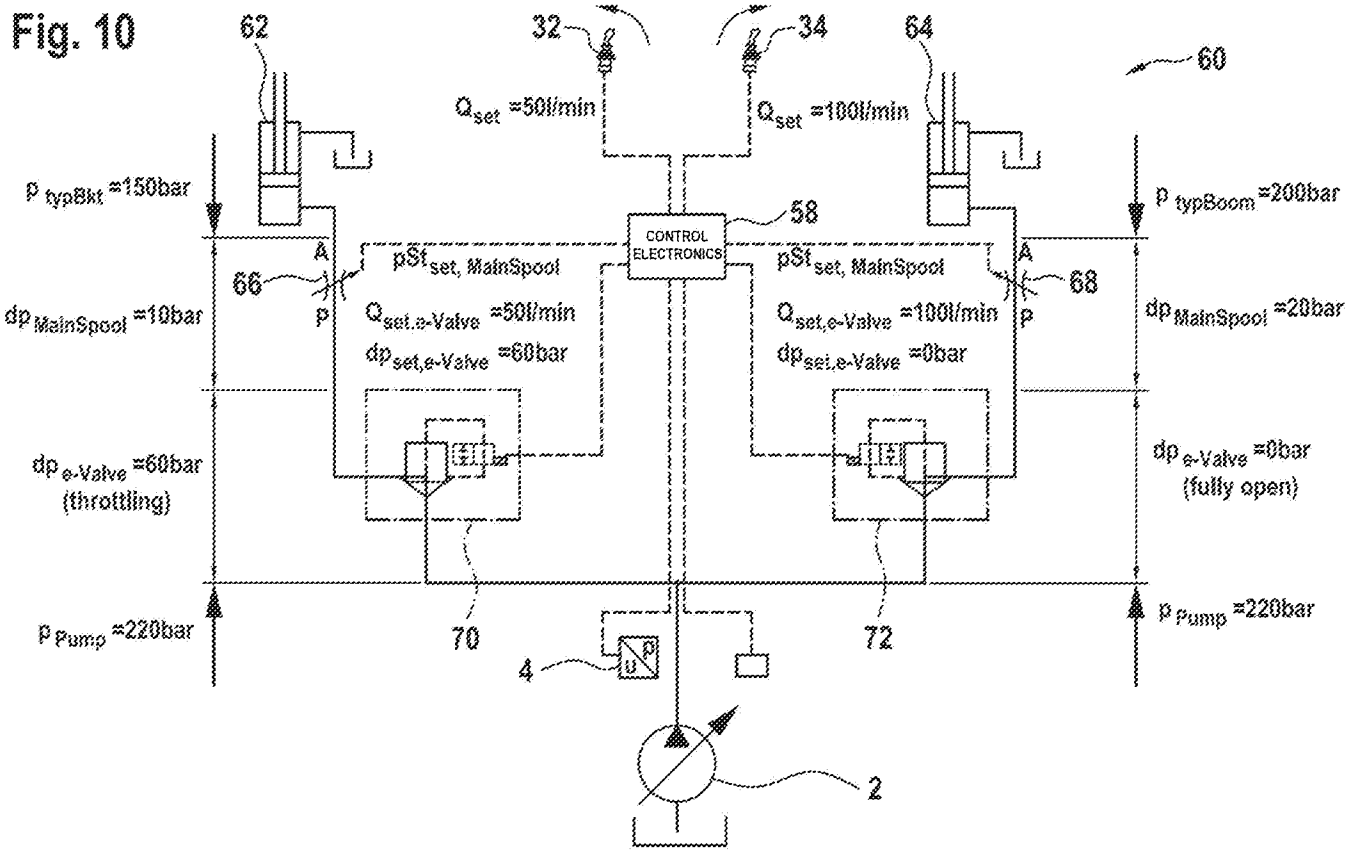
FIG. 10 shows, in a schematic illustration, the valve block arrangement from FIG. 5 with exemplary pressure variables and volume flows.

FIG. 10 illustrates a valve block arrangement 60 in simplified form. Said figure serves for illustrating the control by means of the set of control electronics 58, see also FIG. 7. For the sake of simplicity, no cut valve is illustrated in the valve block arrangement 60. As consumers 62, 64, single-acting hydraulic cylinders are provided. The respective working chamber thereof is connected to a working port A of a respective main spool 66, 68. The consumer 62 serves for example for actuating an excavator bucket, and the consumer 64 serves for example for actuating an excavator boom. Then, to a pressure port P of a respective main spool 66, 68, there is connected in each case one throttle 70, 72, which throttles are designed correspondingly to FIGS. 5 and 6 respectively. The throttles 70, 72 are then connected to the hydraulic pump 2. By means of the set of control electronics 58, the main spools 66, 68, the throttles 70, 72 and the hydraulic pump 2 are adjustable, which is illustrated by the dashed lines shown in FIG. 10. Furthermore, the set of control electronics 58 is connected to the pressure sensor 4. Furthermore, in each case one joystick 32 and 34 for a respective consumer 62 and 64 is connected to the set of control electronics 58.

The consumer 62 is acted on with a typical load pressure (p_typ_Bkt) of 150 bar, and the consumer 64 is acted on with a typical load pressure (p_typ_Boom) of 200 bar.

The joysticks 32 and 34 are in this case actuated such that the consumer 62 should be supplied with a volume flow preset (Q_set) of 50 liters per minute and the consumer 64 should be supplied with a volume flow preset (Q_set) of 100 liters per minute. The pressure drop across the main spool is estimated, on the basis of the setpoint flow rate, as 20 bar.

An outlet-side pressure of the hydraulic pump 2, which can be detected by means of the pressure sensor 4, then amounts to 220 bar. Here, the throttle 72 is fully open, whereby said throttle is flowed through by a volume flow (Q_set_e-valve) of 100 liters per minute and no pressure loss (dp_set_e-valve) is provided. By contrast, the throttle 70 is throttled, such that a volume flow (Q_set_e-valve) of 50 liters per minute can flow through it. There is an estimated pressure drop of 10 bar across the main spool in the case of the demanded 50 l/min. Here, a pump pressure of 160 bar would typically take effect. The difference in pump pressure between the 220 bar of consumer 64 and 62 is now set at throttle 70.

Figure 11:
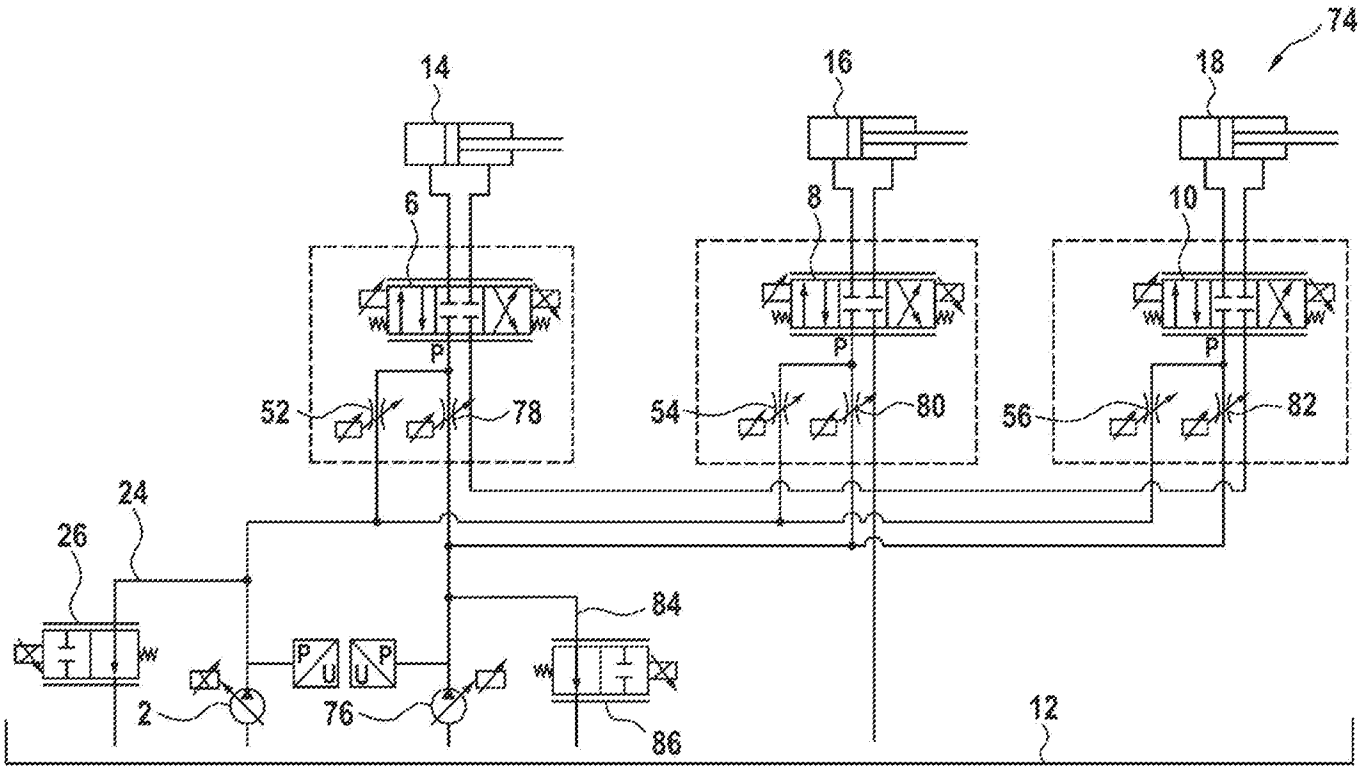
FIG. 11 shows, in a hydraulic circuit diagram, a valve block arrangement according to a further exemplary embodiment.

In FIG. 11, a valve block arrangement 74 is provided. This has, by contrast to the valve block arrangement 50 from FIG. 5, a further hydraulic pump 76 in addition to the hydraulic pump 2. A pressure port P of a respective main spool 6, 8, 10 can then be supplied with pressure medium via both hydraulic pumps 2, 76. The hydraulic pump 2 is, correspondingly to the embodiment in FIG. 5, connected via the throttles 52, 54 and 56 to the respective pressure port P of the main spools 6 to 10. The hydraulic pump 76 is then likewise connected via a respective throttle 78, 80 and 82 to the pressure port P. The throttles 52, 78; 54, 80 and 56, 82 are then connected fluidically parallel to the respective pressure port P of the main spools 6, 8 and 10 respectively.

Correspondingly to FIG. 5, the bypass flow path 24 with the cut valve 26 branches off between the hydraulic pump 2 and the throttles 52, 54 and 56. Furthermore, a bypass flow path 84 is provided in which a cut valve 86 is arranged. Here, the bypass flow path 84 branches off, between the hydraulic pump 76 and the throttles 78, 80 and 82, to the tank 12. The consumers 14, 16 and 18 can thus be supplied with pressure medium in each case by means of two hydraulic pumps 2, 76, and the valve block arrangement 74 can advantageously be controlled in accordance with the designs in the preceding embodiments.

Figure 12:
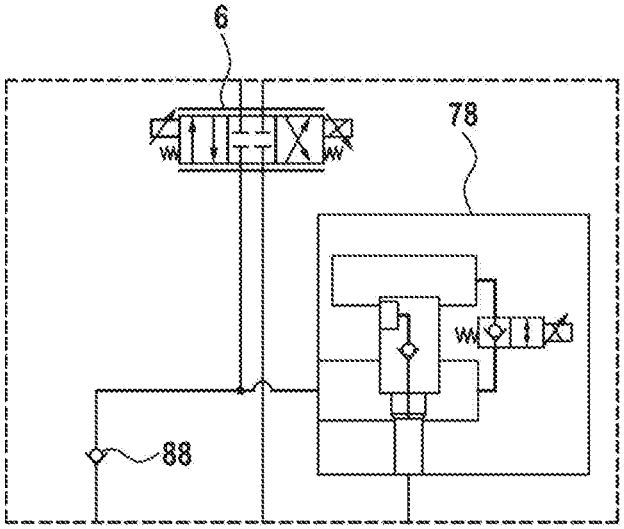
FIG. 12 shows, in a hydraulic circuit diagram, a main spool with upstream throttle and upstream check valve as per an embodiment.

FIG. 12 illustrates an embodiment for the connection of the hydraulic pumps 2, 76 from FIG. 11 to the pressure port P of the main spool 6. Here, a check valve 88 is provided instead of the throttle 52. Said check valve opens in this case in a flow direction from the hydraulic pump 2 toward the pressure port P, and closes in the opposite flow direction. The throttle 78 in FIG. 12 between the hydraulic pump 76 and the pressure port P is in this case designed correspondingly to FIG. 6. It is conceivable for the check valve 88 to also be used in place of the throttle 54 and/or 56, see FIG. 11. It is self-evidently also possible for the check valve 88 to be used as an alternative or in addition to the throttle 78 and/or to the throttle 80 and/or to the throttle 82, see FIG. 11.

Figure 13:
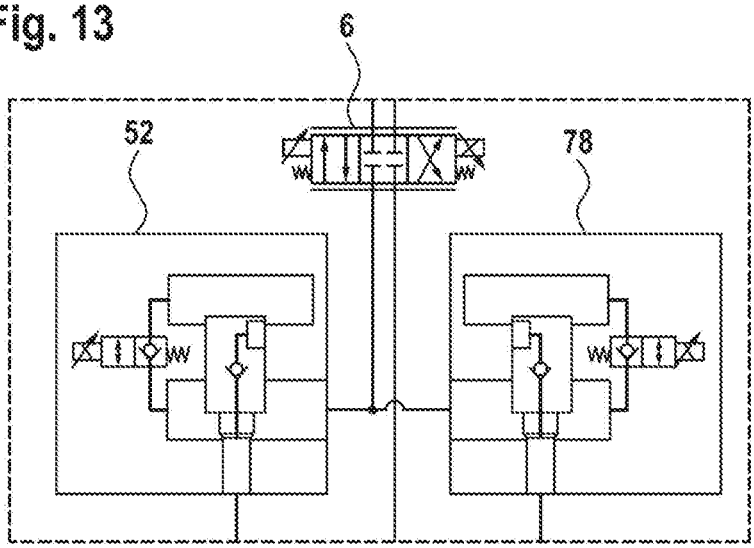
FIG. 13 shows, in a hydraulic circuit diagram, a main spool with two upstream throttles as per an embodiment.

In FIG. 13, the throttles 52 and 78 from FIG. 11 are illustrated together with the main spool 6. As already stated above, said throttles are designed correspondingly to the throttles 52 to 56, see FIG. 6.

Figure 14:
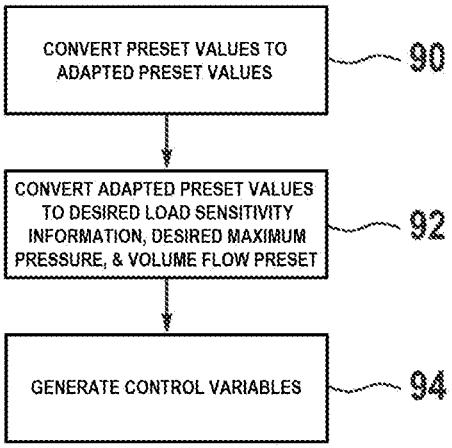
FIG. 14 shows, in a flow diagram, the method according to the disclosure as per an embodiment.

FIG. 14 shows the method for controlling the valve block arrangements 1, 50, 60 and 74 with the set of control electronics 31 and 58. In a first step 90, the preset values a1 to a3 output by the joysticks 32 to 36, see for example FIG. 2, are converted into adapted preset values b1 to b3. Subsequently, in step 92, the adapted preset values b1 to b3 are converted into a desired item of load sensitivity information A1, A2, A3, into a desired maximum pressure p_max_1, p_max_2, p_max_3 and into a respective volume flow preset Q1, Q2, Q3. In the next step 94, control variables for the activatable components are then generated from the converted values and from the adapted preset values together with load pressures p1 to p3.

A valve block arrangement is disclosed, which is designed as a closed center system. Said valve block arrangement has at least one main spool for controlling a hydraulic consumer. The main spool can open and close at least one pressure medium connection between a hydraulic pump and the consumer in controlled, continuous fashion, and is in particular electrically activated. A bypass flow path with a cut valve branches off between the, in particular adjustable, hydraulic pump and the main spool. Said cut valve can open and close a pressure medium connection between the hydraulic pump and a tank in controlled, continuous fashion, wherein said cut valve is electrically activatable.

LIST OF REFERENCE DESIGNATIONS

1; 50; 60; 74 Valve block arrangement
2, 76 Hydraulic pump
4 Pressure sensor
6, 8, 10; 66, 68 Main spool
12 Tank
14, 16, 18; 62, 64 Consumer
20, 22 Actuator
24, 84 Bypass flow path
26, 86 Cut valve
28 Valve spring
30 Actuator
31; 58 Control electronics
32, 34, 36 Joystick
38, 42, 46 Block
40 First module
44 Second module
48 Third module
52, 54, 56; 70, 72, 78, 80, 82 Throttle
88 Check valve
90, 92, 94 Step
P Pressure port
A, B Working port
T Tank port
a Main position
b, c Switched positions
a1, a2, a3 Preset value
b1, b2, b3 Adapted preset value
p_max_1, p_max_2, p_max_3 Maximum pressure
Q1, Q2, Q3 Volume flow preset
A1, A2, A3 Item of load sensitivity information
p1, p2, p3 Load pressure
x1, x2, x3 Control signal for main spool
y1, y2, y3 Control variable for throttle
dp_1, dp_2, dp_3 Pressure drop across throttle
x_cut Control signal for cut valve
V_g Total volume flow preset
n Rotational speed of the hydraulic pump

What is claimed is:

1. A valve block arrangement, comprising:

a closed center valve block having at least one main spool configured to control a hydraulic consumer, the at least one main spool assigned a pressure port and a working port;

at least one hydraulic machine connected to the pressure port;

a bypass flow path branching off fluidically between the pressure port and the at least one hydraulic machine;

an electrically activated cut valve configured to connect the bypass flow path to a tank, the cut valve configured to throttle the bypass flow path; and control electronics comprising:

a preset module configured to determine an item of load sensitivity information based on a preset value received for consumer input by an input unit, the item of load sensitivity information being inversely related to the preset value; and an actuation module configured to generate an actuation signal for the cut valve based on the item of load sensitivity information.

2. The valve block arrangement according to claim 1, further comprising:

at least one further main spool, the at least one further main spool configured in each case to control a respective further hydraulic consumer, wherein each respective main spool of the at least one further main spool is assigned a respective pressure port and a respective working port, wherein the at least one hydraulic machine is connected to each respective pressure port, wherein the bypass flow path with the cut valve branches off fluidically between the respective pressure ports and the at least one hydraulic machine, wherein the preset module is further configured to determine respective further items of load sensitivity information based on respective further preset values input by respective further input units, the further items of load sensitivity information being inversely related to the respective further preset values; and the actuation module is further configured to generate the actuation signal for the cut valve based on the item of load sensitivity information and the further items of load sensitivity information.

3. The valve block arrangement according to claim 2, wherein each respective spool of the at least one main spool and the at least one further main spool is assigned an adjustable throttle disposed fluidically between the pressure port of the respective spool and the hydraulic machine.

4. The valve block arrangement according to claim 2, wherein one or more of (i) at least one of the main spools is adjustable in continuous fashion, (ii) the cut valve is openable and closable in controlled, continuous fashion, and (iii) the hydraulic machine is adjustable in continuous fashion.

5. The valve block arrangement according to claim 3, wherein each adjustable throttle is configured such that a backflow of pressure medium from the associated consumer is prevented by the adjustable throttle.

6. The valve block arrangement according to claim 2, wherein the pressure port of at least one of the main spools is connected to at least two hydraulic machines arranged fluidically in parallel.

7. The valve block arrangement according to claim 1, wherein:

the control electronics further comprises an adaptation module configured to receive the preset value and convert the preset value into an adapted preset value, and the preset module is configured to determine the item of load sensitivity information based on the adapted preset value.

8. The valve block arrangement according to claim 7, wherein the preset module is further configured to convert the adapted preset value into one or more of a volume flow preset for the consumer and a maximum pressure for the consumer.

9. The valve block arrangement according to claim 8, wherein the actuation module is further configured to generate additional actuation signals based on the adapted preset values, the additional actuation signals including one or more of a total volume flow preset for the hydraulic machine, a control variable for the main spool, and a control variable for at least one throttle that is arranged between the each respective spool of the at least one main spool and the at least one hydraulic machine.

10. The valve block arrangement according to claim 9, wherein the actuation module is further configured to generate the additional actuation signals based on a load pressure of the consumer.

11. The valve block arrangement according to claim 9, wherein the actuation module is further configured to generate the additional actuation signals based on a rotational speed of the hydraulic machine.

12. The valve block arrangement according to claim 7, wherein the adaptation module, the preset module, and the actuation module are software modules.

13. The valve block arrangement according to claim 9, wherein the actuation by the actuation signal and the additional actuation signals takes the form of non-feedback open-loop control.

14. A method for a valve block arrangement that includes a closed center valve block with at least one main spool configured to control a hydraulic consumer, the at least one main spool assigned a pressure port and a working port; at least one hydraulic machine connected to the pressure port; a bypass flow path branching off fluidically between the pressure port and the at least one hydraulic machine; and an electrically activated cut valve configured to connect the bypass flow path to a tank and to throttle the bypass flow path, the method comprising:

receiving a preset value for the consumer input by an input unit in an adaptation module;

converting one of the preset value and an adapted preset value adapted from the preset value into an item of load sensitivity information for the consumer with a preset module, the item of load sensitivity information being inversely related to the one of the preset value and the adapted preset value; and generating an actuation signal for the cut valve based on the item of load sensitivity information in an actuation module.

* * * * *